US005403197A

United States Patent [19]

Ernst et al.

[11] Patent Number: 5,403,197

[45] Date of Patent: Apr. 4, 1995

[54] ANTENNA EXTENDER APPARATUS

[75] Inventors: David J. Ernst; Daniel K. Kaspari, both of Cedar Rapids; Scott R. Murphy, Marion, all of Iowa

[73] Assignee: Rockwell International Corporation, Seal Beach, Calif.

[21] Appl. No.: 114,266

[22] Filed: Aug. 30, 1993

[51] Int. Cl.[6] ..... H01R 3/00

[52] U.S. Cl. ..... 439/165; 439/4; 439/916; 343/702; 343/906

[58] Field of Search ..... 343/702, 906; 439/165, 439/916, 4

[56] References Cited

U.S. PATENT DOCUMENTS

| | | | |
|---|---|---|---|
| 2,491,713 | 12/1949 | Carington et al. | 250/33 |
| 2,497,687 | 2/1950 | Pickett et al. | 250/33 |
| 3,423,518 | 1/1969 | Weagant | 174/153 |
| 4,790,774 | 12/1988 | White | 439/551 |
| 4,890,114 | 12/1989 | Egashira | 343/702 |
| 5,218,370 | 6/1993 | Blaese | 343/702 |

*Primary Examiner*—Eugene F. Desmond

*Attorney, Agent, or Firm*—Kyle Eppele; M. Lee Murrah; H. Frederick Hamann

[57] ABSTRACT

An adjustable rugged antenna coupler assembly for primary use in portable radios. Connector means in combination with a pair of gasket means, signal carrying means and encasement means combine to provide an improved adjustable antenna coupler assembly. The connector means is mated with complementary threadings in the radio casing thereby providing an antenna coupler readily adjustable such that the antenna is always pointed in a desired direction, such as skyward.

9 Claims, 2 Drawing Sheets

ANTENNA EXTENDER APPARATUS

BACKGROUND OF THE INVENTION

The present invention relates generally to antenna mountings and more particularly to an environmentally rugged a infinitely adjustable structure for mounting a mobile antenna capable of withstanding stringent environmental applications.

Prior to the present invention a variety of structures have been devised for mounting antennas to portable radios. Representative of such structures are apparatuses having a ratchet or detent bushing attached using ring clamps or a press fit assembly, or a fixed mounted whip antenna structure. Such structures have provided satisfactory solutions to various design challenges, but suffer failure and system degradation due to mechanical wear associated with adjusting of the antenna. Additionally, sand, dust or other contaminants may enter the apparatus thereby causing premature failure or difficult operational use. Water damage, a particular type of contaminant, can be especially troublesome with prior art techniques failing to adequately address such concerns in high humidity or immersed conditions.

Another significant shortcoming of numerous prior art structures concerns coupling the signal from the antenna to the associated device. Slide connections and directly coupled coaxial cables have typically been used, but generally result in intermittent failure and an overall shortened life of the structure.

Accordingly, a need exists for an improved antenna extender apparatus capable of prolonged use in an application requiring an adjustable antenna that is environmentally rugged.

SUMMARY OF THE INVENTION

The present invention discloses an adjustable rugged antenna extender apparatus for primary use in portable radios. The antenna extender apparatus comprises, in combination, connector means, gasket means and signal coupling means all enclosed, supported and protected by encasement means. The connector means serves to provide infinite adjustment of the attached antenna by rotating such device. The gasket means, signal coupling means and encasement means each serve to enhance operational performance of the antenna, as adjusted.

In one embodiment of the above apparatus, a hollow cylindrical, metallic, threaded lug type bushing serves as the connector means, with a pair of O-rings serving as the gasket means, a flexible coiled coaxial cable serving as the signal coupling means and a molded polyurethane hood having a bottom and top member serving as the encasement means, all combining to provide an improved adjustable antenna extender apparatus. The threaded lug bushing is mated with a complementary threaded coupler in the casing of an accompanying radio device, thereby providing an antenna extender apparatus that is readily adjustable such that the antenna may always be pointed in a desired direction, such as skyward.

It is therefore an object of the present invention to disclose an antenna extender apparatus that provides a readily adjustable and ruggedized performance over a protracted period of usage.

It is a feature of the present invention to utilize a flexible coiled coaxial cable for coupling an antenna signal to the accompanying radio circuitry.

It is an advantage of the present invention that a rugged antenna extender apparatus is disclosed.

The foregoing as well as other objects, features and advantages of the present invention will become better understood from the following detailed description taken in conjunction with the various views of the appended drawings.

DETAILED DESCRIPTION OF THE DRAWINGS

Figure 1:
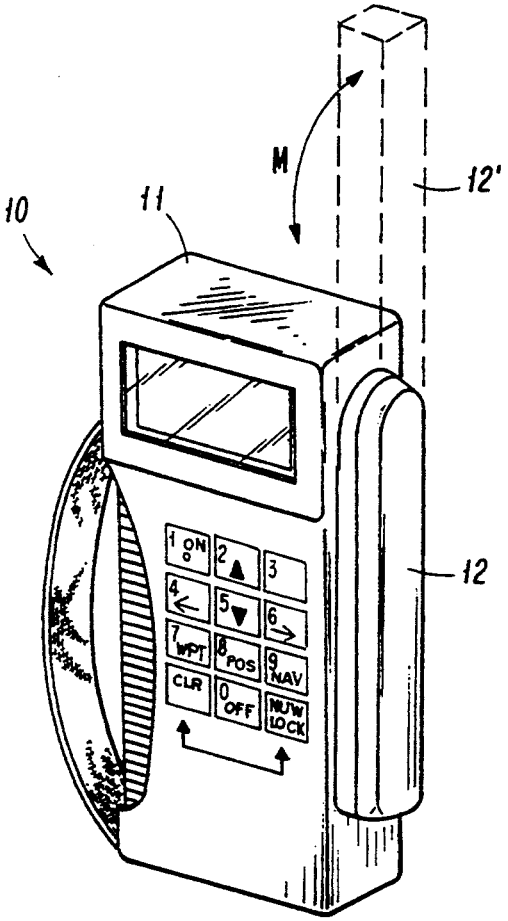
FIG. 1 is a front elevation of a radio apparatus incorporating the teachings of the present invention.

Turning now to the Figures, wherein like items are referenced as such throughout, FIG. 1 illustrates a handheld Global Positioning Satellite (GPS) receiver 10 that incorporates the teachings of the present invention. It should be noted that use of a GPS type receiver is for illustration only and is not a limitation of the present invention as such apparatus might easily be adapted to any variety of applications such as radios, transmitters, portable phones, helmet integrated antennas and the like. The GPS receiver 10 is shown to have a variety of control and monitoring features, obvious from the depiction, as well as an antenna extender apparatus 12 for coupling an antenna 14 (See FIG. 3) to the chassis 11 of the GPS receiver 10. The antenna extender apparatus 12 is shown in the stowed position (solid lines) and also in one of infinite possible deployed positions. The deployed antenna extender apparatus is represented by a dashed depiction 12', and is understood to move within the arc described by arrow M.

Figure 2:
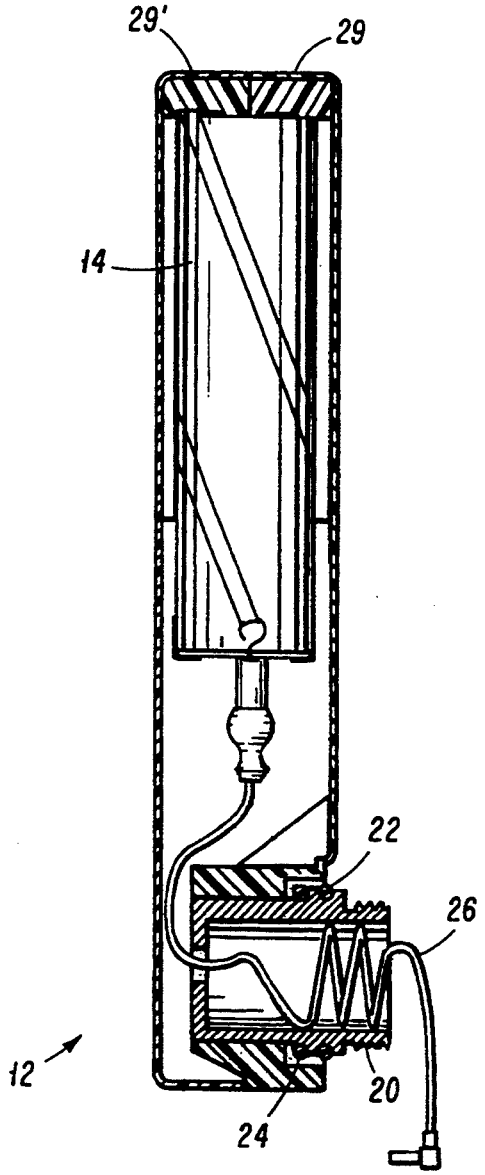
FIG. 2 is a longitudinal side elevation of an antenna and an antenna extender apparatus incorporating the teachings of the present invention.

FIG. 2 illustrates the antenna extender apparatus 12 in a longitudinal cross-section view. The antenna extender apparatus 12 is comprised of bearing means 20 (hereinafter understood to serve as connector means), first and second gasket means 22, 24, signal coupling means 26 and encasement means having a bottom and top member 29, 29', respectively. Bearing means 20 is shown to be a generally cylindrical shaped lug type bushing device having external threads and a hollow center with openings at both ends. The bushing device may be metallic in composition or some other material suitable for the life expectancy stress and strain. The signal coupling means 26 is shown to be a flexible coiled coaxial cable of such length and overall dimensions as design requirements dictate. The flexible coiled coaxial cable passes through the hollow center portion of bearing means 20, via the opening on either end of bearing means 20. Gasket means 22, 24, are O-rings snugly engaged in grooved recesses on the outer surface of bearing means 20. Encasement means 29, 29' consists of molded polyurethane pressed together and held in place by glue, plastic welding or other suitable fastener techniques. Encasement means members 29, 29' are shown to form a shallow cavity about gasket means 22, 24. Bearing means 20 is understood to be permanently affixed to encasement means top member 29. An antenna 14 is coupled to one end of the flexible coiled coaxial cable 26 and is generally cylindrically shaped having metallic strands affixed on the outer surface providing a general "barber shop pole" appearance. The antenna is discretionary with and determined by the accompanying radio. No claim is herein made to the antenna.

Figure 3:
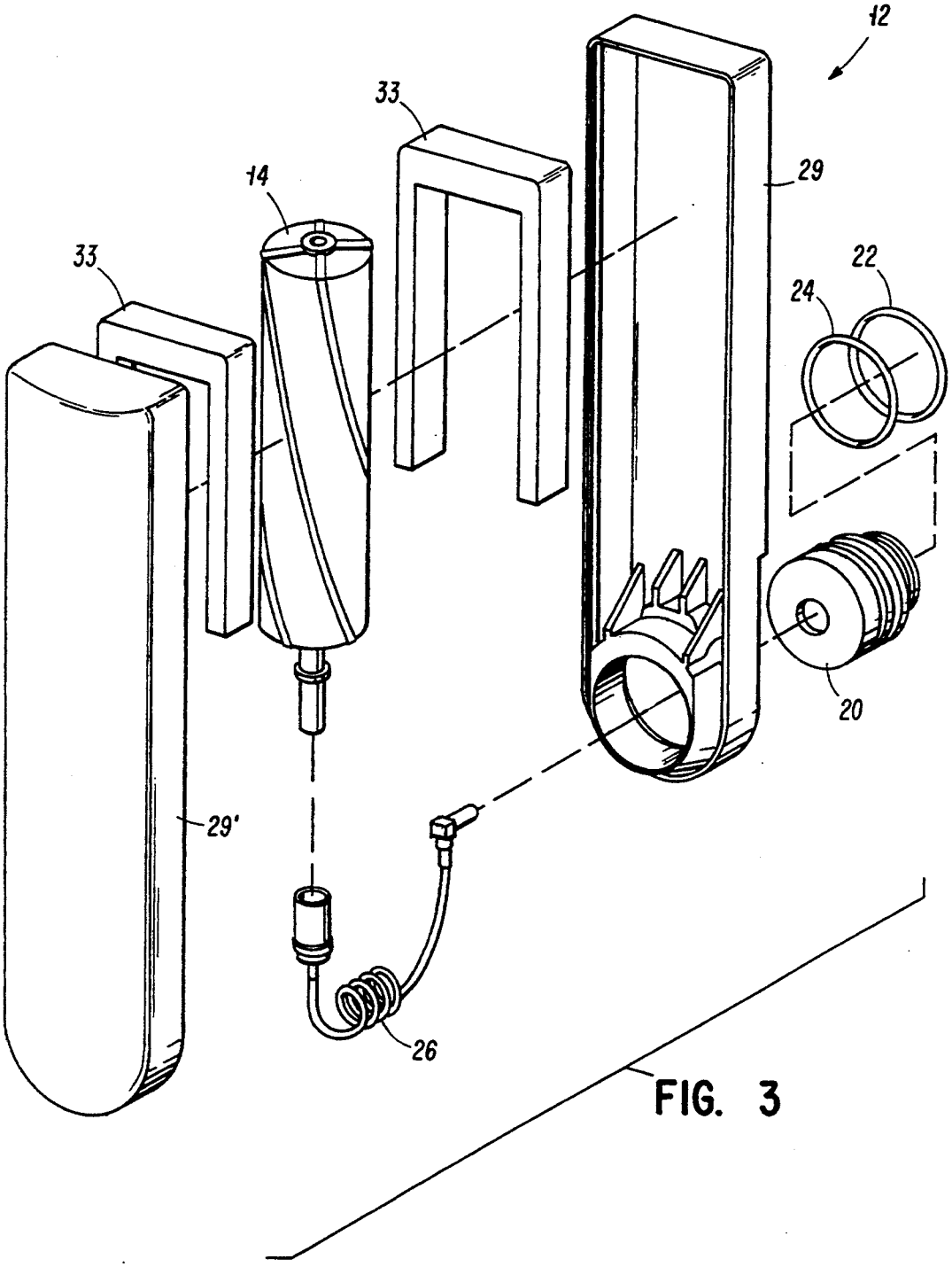
FIG. 3 is an exploded orthogonal view of the embodiment of the antenna extender apparatus depicted in FIG. 1.

FIG. 3 illustrates one embodiment of the antenna extender apparatus 12 of FIG. 1 in exploded orthogonal view. Encasement means comprised of the bottom member 29 and the bottom member 29 is generally rectangular shaped, although shown to be curved on its end integral to bearing means 20. Bearing means 20 is more clearly shown having an opening on its end enclosed within encasement means members 29, 29', for allowing the flexible coiled coaxial cable signal to be coupled to the antenna 14. Antenna support means 33, such as foam rubber, or the like, may be used to restrict movement of the antenna 14 within the encasement device.

In operation, the antenna extender apparatus 12 works in combination with a threaded aperture in the case of the GPS receiver 10. The antenna extender apparatus 12 readily rotates through a semicircle arc, (See FIG. 1) thereby providing the ability to easily adjust the antenna so that it is aligned to a given reference plane, such as the earth's surface, in a desired manner without intermittent locked positions. The inclusion of dual O-rings 22, 24 serve to environmentally protect the internal compartment of the GPS receiver 10 and the antenna extender apparatus 12 from contamination, such as dirt or moisture. If so desired, stops such as rubber pads (not shown) may be affixed to the GPS receiver 10 within the plane of movement of the antenna extender apparatus 12 so that once assembled, adjustment of the antenna extender apparatus 12 does not result in unintentional disassembly during normal and/or repeated adjustments.

The above disclosure provides an infinitely variable positioning antenna extender apparatus by using a combination of bearing means, a plurality of O-rings, and a flexible coiled coaxial cable. The threaded bearing means provides a positive lead-in for the rotation of the antenna extender apparatus as well as a mechanism to retain the antenna extender apparatus to the chassis of the underlying device. The O-rings provide several key design attributes. First the interference fit between the dual O-rings, the bearing means and the underlying device provides a smooth rotation and the necessary friction to hold the antenna in the desired position. Secondly, the O-rings provide an immersion proof seal, as well as, a sand and dust tight design. As the antenna is rotated, the threaded bearing means draws the antenna extender apparatus inwards which causes a wiping action on the antenna extender apparatus thereby keeping the contact area clean. As the antenna extender apparatus is rotated, the flexible coiled coaxial cable absorbs the rotation in its coiled portion, similar in principle to a coiled spring. The coil diameter decreases while increasing the number of coils. This eliminates the stress on the connections of the flexible coiled coaxial cable. To further enhance longevity, slip ring connectors may be used on either end of the flexible coiled coaxial cable. Additionally, the present invention utilizes a high impact molded encasement device to absorb shock or impact loading. Any commercially available material such as molded polyurethane, as utilized in the embodiment of FIG. 2, would suffice for gaining the advantages of the present invention.

Those skilled in the art will readily recognize that various modifications and changes may be made to the present invention without departing from the true spirit and scope thereof, which is set forth in the following claims.

I claim:

1. An apparatus for connecting an antenna to a radio having an antenna coupler support means, said apparatus comprising:

connector means for structurally mating the antenna to the radio;

flexible signal carrying means for coupling the antenna to the radio;

gasket means affixed to the connector means for sealing the radio and the connector means from environmental contamination and for providing frictional resistance between the connector means and the radio; and encasement means for protecting and supporting the connector means, the signal carrying means and the gasket means, such that rotational movement of the encasement means in the plane of the connector means provides angular adjustment of the antenna coupler support means and the attached antenna.

2. The apparatus of claim 1 wherein the connector means is comprised of a cylindrical shaped, metallic, externally threaded, hollow lug bushing.

3. The apparatus of claim 1 wherein the flexible signal carrying means is comprised of a coiled coaxial cable.

4. The apparatus of claim 1 wherein the gasket means is comprised of a pair of O-rings.

5. The apparatus of claim 1 wherein the encasement means is comprised of a top and a bottom member of molded polyurethane.

6. An apparatus for connecting an antenna to a signal and support structure, said apparatus comprising:

bearing means for structurally mating the antenna to the radio;

a flexible coiled coaxial cable extending through the bushing means and connecting the antenna;

gasket means affixed to the bearing means for sealing the radio and the connecting apparatus from environmental contamination for providing frictional resistance between the connector means and the radio; and encasement means for protecting and supporting the bearing means, the flexible coiled coaxial cable and the gasket means, such that rotational movement of the encasement means in the plane of the bearing means provides angular adjustment of the antenna coupler support means and attached antenna.

7. The apparatus of claim 6 wherein the bearing means is comprised of a cylindrical shaped, metallic, externally threaded, hollow lug bushing.

8. The apparatus of claim 6 wherein the gasket means is comprised of a pair of O-rings.

9. The apparatus of claim 6 wherein the encasement means is comprised of a top and a bottom member of molded polyurethane.

* * * * *